US005078619A

United States Patent [19]

Whittle et al.

[11] Patent Number: 5,078,619

[45] Date of Patent: Jan. 7, 1992

[54] COAXIAL CABLE TERMINAL

[75] Inventors: Daniel J. Whittle, Raleigh, N.C.; David Sawdon, South Wonston; John L. Gorton, Brockenhurst, both of United Kingdom

[73] Assignee: International Business Machines Corporation, Armonk, N.Y.

[21] Appl. No.: 716,188

[22] Filed: Jun. 17, 1991

[30] Foreign Application Priority Data

Sep. 24, 1990 [GB] United Kingdom ..... 9018950

[51] Int. Cl.[5] ..... H01R 13/00

[52] U.S. Cl. ..... 439/578

[58] Field of Search ..... 439/578–585

[56] References Cited

U.S. PATENT DOCUMENTS 3,825,874 7/1974 Peverill ..... 439/579

4,790,775 12/1988 David ..... 439/579

*Primary Examiner*—Joseph H. McGlynn

*Attorney, Agent, or Firm*—Joscelyn G. Cockburn

[57] ABSTRACT

A coaxial cable terminal (20) of unitary construction is described. The terminal (20) comprises means cooperative with an outer conductor (12) of a coaxial cable (10) for providing electrical conduction between the outer conductor (12) and a plurality of elongated conductive contacts (22,23) of a non-coaxial connector (50); and integral means (24) for supporting an inner conductor (11) of the coaxial cable (10) in isolation from the contacts (22,23).

10 Claims, 4 Drawing Sheets

COAXIAL CABLE TERMINAL

The present invention relates to a coaxial cable terminal.

A conventional coaxial cable comprises a copper inner conductor separated from a braided copper outer conductor by a dielectric material. Coaxial cables provide a constant impedance transmission medium for coupling high frequency data signals between noise sensitive high frequency electrical circuits such as, for example, video signal source and amplifiers in computer display systems. The outer conductor can be connected at each end of the coaxial cable to act as a shield to protect data signals on the inner conductor from electromagnetic interference generated by external noise sources. The outer conductor can also be connected to cancel any electromagnetic interference generated by data signals on the inner conductor. However, electromagnetic interferance will escape from the coaxial cable if the outer conductor is terminated incorrectly at either or both ends of the cable.

In order to permit removal of these circuits from the display device, or to enable disconnection of the display device from a video signal source such as a computer, the coaxial cable is terminated at each end in a connector. In many cases, it is convenient to terminate the cable in a conventional coaxial connector such as a so-called BNC connector or a jack plug. However, in some display devices, the coaxial cable is one of a bundle of coaxial cables terminated at one end in a non coaxial multiple pin connector such as the so-called D-type connector. In a D-type connector, the outer conductor of each coaxial cable is preferably terminated in a separate pin positioned adjacent to a pin termination of the corresponding inner conductor. The separate pin termination thus extends the outer conductor through the connector. However, the outer conductor of each coaxial cable cannot easily be secured to an appropriate separate pin termination in isolation from adjacent shields of other coaxial cables in the bundle.

Conventionally, the outer conductor of each coaxial cable is drawn away from the dielectric material and soldered to a separate insulated wire or "pig tail". The pig tail is then secured to the appropriate pin termination.

The pigtail does not provide an effective shield in the region close to the pin termination of the inner conductor. Furthermore, the pig tail acts as an aerial for transmitting and receiving noise between the coaxial cable and equipment in the vicinity of the connector. Securing pig tails to bundles of coaxial cable can also be a labour intensive and therefore costly manufacturing exercise.

The aim of the present invention is therefore to provide a coaxial cable terminal for terminating the outer conductor in a non-coaxial multiple pin connector.

In accordance with the present invention, there is now provided a coaxial cable terminal of unitary construction comprising means cooperative with an outer conductor of a coaxial cable for providing electrical conduction between the outer conductor and a plurality of elongated conductive contacts of a non-coaxial connector; and integral means for supporting an inner conductor of the coaxial cable in isolation from the contacts.

This has the advantage that the terminal of the present invention provides a shielded coaxial cable termination which is compatible with a non-coaxial multiple contact connector such as a D-type connector.

In preferred examples of the present invention, the contacts are interconnected by and extend from one end of a barrel portion open to each end and having a uniform inner diameter commensurate with the outer diameter of a dielectric material separating the inner conductor from the outer conductor. Preferably, the barrel portion has a central longitudinal axis extending parallel to and equidistant from the longitudinal axes of the contacts. The longitudinal axes of the contacts are preferably equiangularly spaced around the barrel portion.

This has the advantage that the barrel portion can act as an extension of the outer conductor for providing a shield against undesirable electromagnetic interferance within the connector.

The terminal of the present invention is of unitary construction which can be formed cheaply either from a single planar blank stamped from sheet metal or from a plurality of separate portions interconnected by welding or soldering.

in a preferred embodiment to be described later the coaxial cable terminal of the present invention is provided with two contacts. The contacts are coplanar with the central longitudinal axis.

An embodiment of the present invention will now be described, by way of example only, with reference to the accompanying drawings in which.

Figure 1:
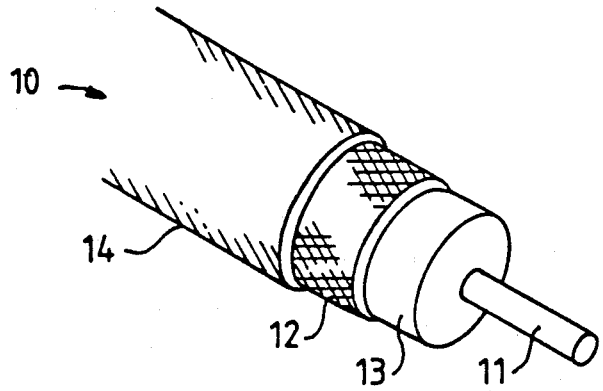
FIG. 1 is a cut away view of a coaxial cable.

FIG. 1 shows a coaxial cable 10 comprising an inner conductor 11 separated from a outer conductor 12 of copper braid by a dielectric material 13. The outer conductor 12 is clad in a sleeve 14 of resilient insulating plastics material. In use, the sleeve 14 is removed towards the end of the cable to expose the outer conductor 12. A section of the outer conductor 12 close to the end of the cable is removed to expose the dielectric material 13. The tip of the dielectric material 13 is removed to expose the inner conductor 11 in isolation from the outer conductor 12.

Figure 2:
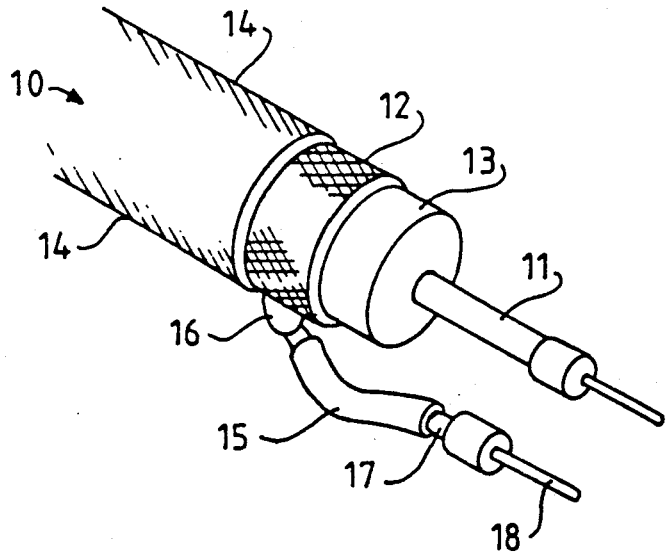
FIG. 2 is an isometric view of a pigtail attached to the coaxial cable.

FIG. 2 shows a pigtail 15 comprising a length of insulated wire of about the same diameter as the inner conductor 11 and stripped of insulation towards to each end. One stripped end 16 is soldered to the exposed outer conductor 12. The length of the wire is selected to dispose the remaining free end 17 in line with the exposed tip of the inner conductor 11. The exposed tip 11 and the free end 17 are crimped onto separate contacts in the form of pins 18,19 for inserting into adjacent receptive apertures in a non coaxial multiple pin connector shell. In other examples of the prior art, the contacts are in the form of receptacles for inserting into adjacent locating apertures of a non coaxial multiple socket connector. In further examples of the prior art the contacts of a multiple contact connector comprise solder buckets or soldering to the free end and the exposed tip.

Figure 3:
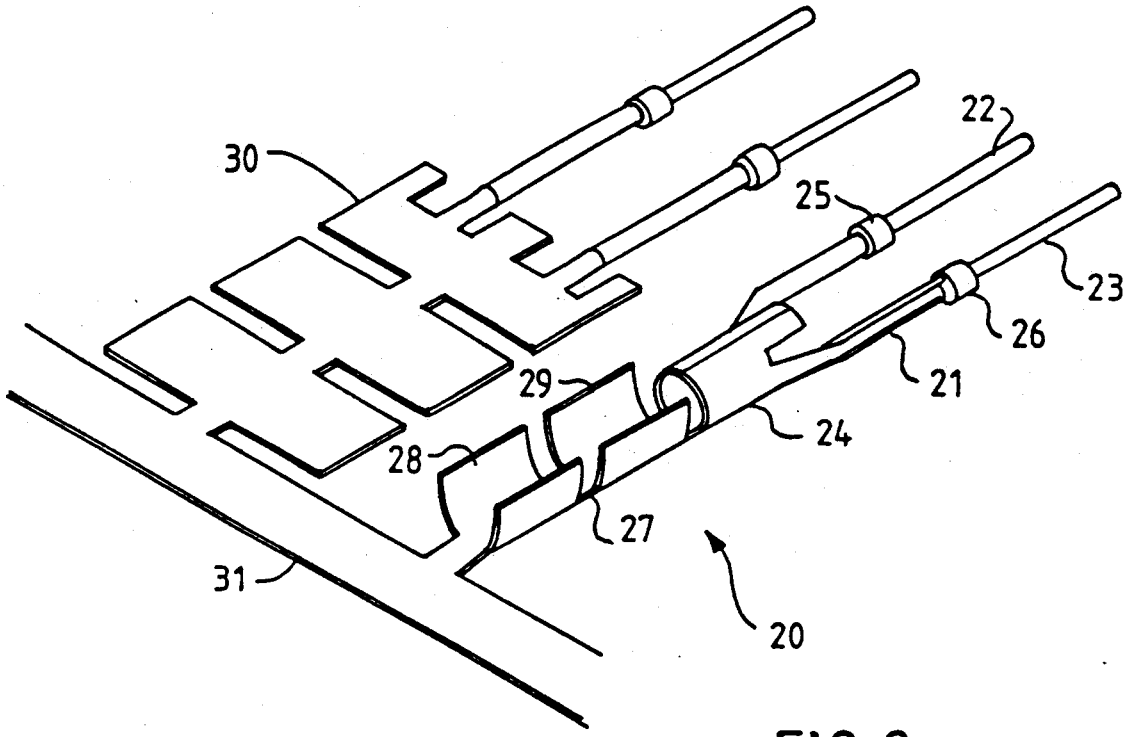
FIG. 3 is an isometric view of a terminal of the present invention and a blank for forming such a terminal.

FIG. 3 shows a coaxial cable terminal 20 in accordance with the present invention. The coaxial cable terminal 20 comprises a contact portion 21 having a pair of coplanar pins 22,23 for inserting into coplanar apertures of a non coaxial multiple pin connector shell. Each pin is provided with a collar 25,26 for engaging with the apertures. The pins 22,23 are interconnected by and extend from one end of a barrel portion 24 having a central longitudinal axis coplanar with and equidistant from the pins 22,23. The pins 22,23 thus extend parallel to the central longitudinal axis of the barrel portion 24. The barrel portion 24 is open to each end and has an inner diameter commensurate with the outer diameter of the dielectric material 13. The barrel portion 24 acts as an extension of the outer conductor 12 around the dielectric 13 while supporting the exposed tip in isolation from the pins 22,23. An attachment portion 27 comprising first and second substantially U-shaped channels 28,29 connected in series extends from the end of the barrel portion 24 remote from the pins 22,23. The U-shaped channels 28,29 have centres located along the central longitudinal axis of the barrel portion 24. The first U-shaped channel 29 is adjacent to the barrel portion 24 and has an inner diameter commensurate with the outer diameter of the braid. The second U-shaped channel 28 is remote from the barrel portion 24 and has an inner diameter commensurate with the outer diameter of the sleeve 14.

The coaxial cable terminal 20 of the present invention is of unitary construction preferably formed from a planar metal blank 30. The blank 30 is stamped to a pattern out of sheet metal. Preferably, plural coaxial cable terminals are formed on a single bandolier 31 by sequentially stamping blanks 30 to the same pattern. The bandolier 31 can be fed into an automatic crimping machine for crimping the terminals to a series of coaxial cables passing along a production line. The bandolier 31 can be supplied on a reel permitting convenient storage of the terminals. Other coaxial cable terminals of unitary construction in accordance with the present invention may be formed by welding separate contacts, barrel portions and attachment portions together.

in use, the coaxial cable 10 to be terminated is prepared for insertion into the terminal 20 of the present invention by removing the sleeve 14, outer conductor 12, and dielectric material 13 in stages towards one end. FIG. 1 shows a coaxial cable 10 having a prepared end.

Figure 4:
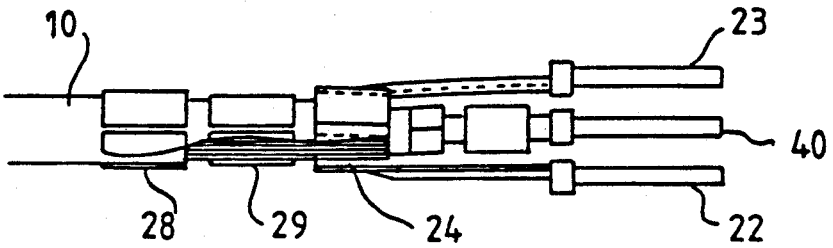
FIG. 4 is a plan view of the coaxial cable secured to a coaxial cable terminal of the present invention.

FIG. 4 shows the prepared end of the coaxial cable secured to the terminal 20 of the present invention. The exposed dielectric material is inserted through the barrel portion 24 to position the exposed tip parallel to the pins 22,23 and along the central longitudinal axis of the terminal. A separate central pin 40 is then crimped onto the exposed tip of the inner conductor. The outer conductor 12 rests in the first U shaped channel 29 and the sleeve 14 rests in the second U shaped channel 28. The first U-shaped channel 29 is crimped onto the outer conductor 12 to conductively secure the outer conductor 12 to the contacts. The second U-shaped channel 28 is crimped onto the sleeve 14 to secure the cable to the terminal 20. It will be appreciated that in other examples of the present invention, the outer conductor and the sleeve may be secured to the terminal by other types of crimp receptacles such as ring or star crimps.

Figure 5:
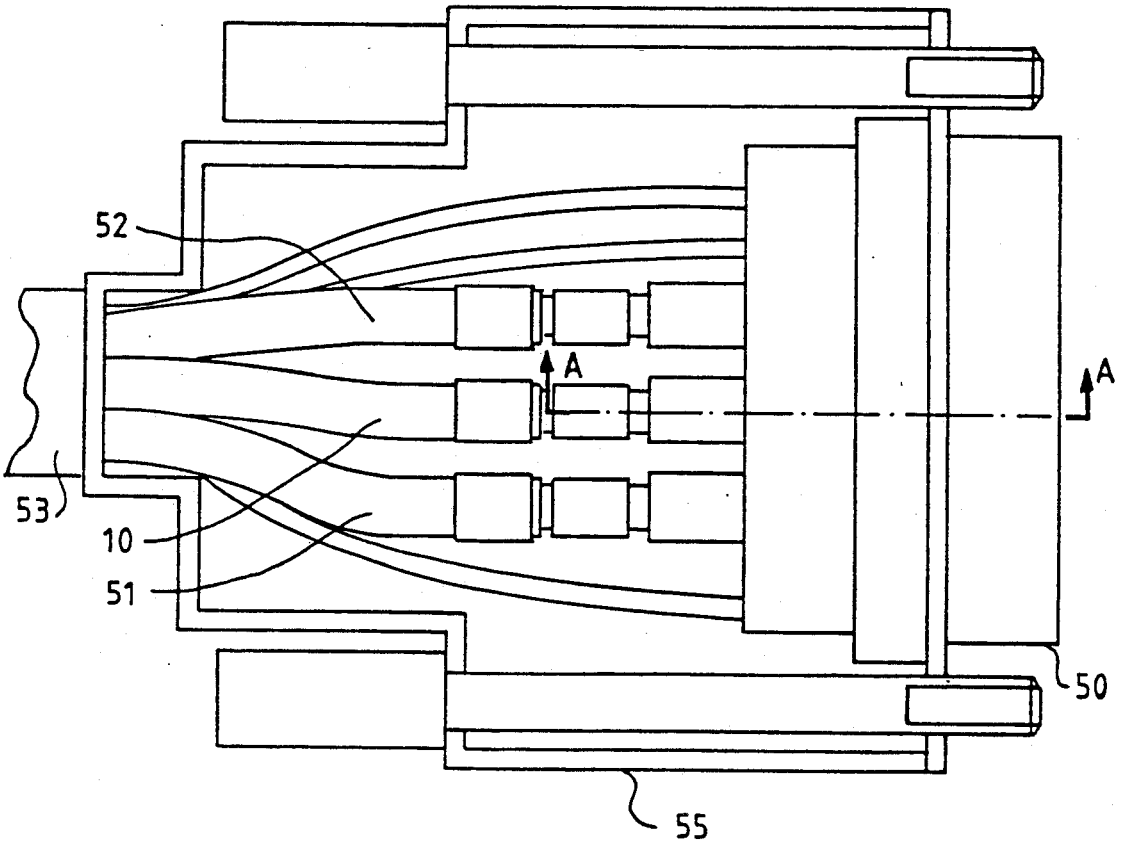
FIG. 5 is a plan view of a non coaxial multiple pin connector comprising three coaxial cable terminals of the present invention.
Figure 6:
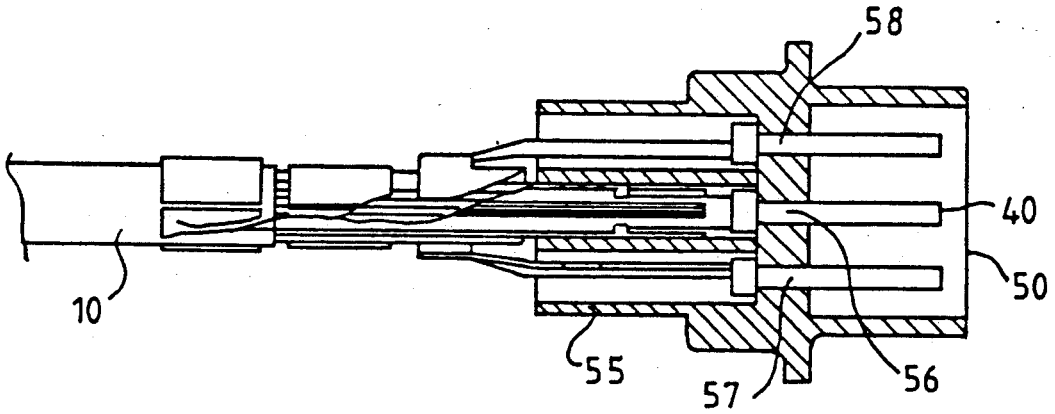
FIG. 6 is a cross-sectional view of the connector illustrated in FIG. 5 when viewed in the direction of arrows A in the plane A—A.
Figure 7:
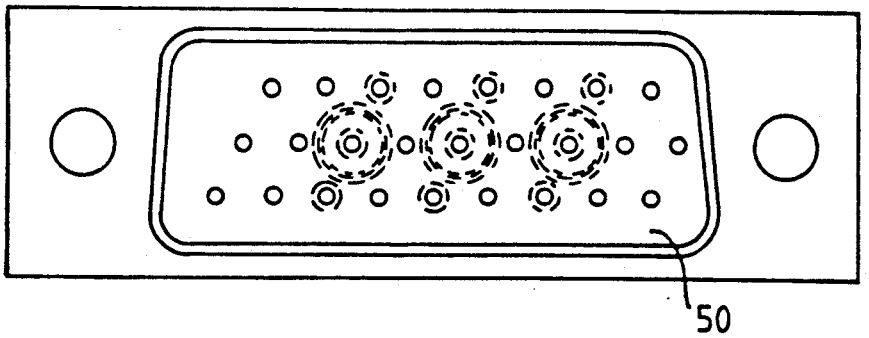
FIG. 7 is an end view of the connector viewed in the direction of arrow B.

FIGS. 5, 6, and 7 illustrate a D-type connector 50 comprising twenty pins. The connector is attached to a bundle 53 of cables comprising three coaxial cables 51,10,52. The coaxial cables 51,10,52 are terminated in three separate terminals 53,20,54 within the connector. The connector comprises a connector shell 55 having six columns comprising three coplanar apertures. Three of the columns support the three coaxial cable terminals 53,20,54. Each column has a central aperture 56 receiving the central pin 40 secured to the inner conductor 11 of a different one of the three coaxial cables 51,10,52, and two peripheral apertures 57,58 receiving the two contact pins 22,23 of the terminal 20 to which the corresponding outer conductor 12 of the coaxial cable 10 is secured. The U shaped portions 28 and 29 are arranged to ensure that the central pin 40 protrudes slightly from the peripheral pins 22,23. Therefore, during insertion of the terminal 20 into the shell 55, the central pin 40 latches into the central aperture 56 before the peripheral pins 22,23 latch into the peripheral apertures 57,58. After insertion, the barrel portion 24 abuts with the shell 55 around the entrance to the central aperture 56. The barrel portion 24 therefore acts as an extension of the outer conductor 12 over the exposed dielectric up to the central aperture 56. The outer conductor 12 is further extended in parallel with the central pin 40 received in the central aperture 56 by the coplanar pins 22,23 received in the peripheral apertures 57,58.

The shielding of the inner conductor 11 from interfering signals entering the connector 50 is therefore optimised.

We claim:

1. A coaxial cable terminal (20) of unitary construction comprising means cooperative with an outer conductor (12) of a coaxial cable (10) for providing electrical conduction between the outer conductor (12) and a plurality of elongated conductive contacts (22,23) of a non-coaxial connector (50); and integral means (24) for supporting an inner conductor (11) of the coaxial cable (10) in isolation from the contacts (22,24).

2. A coaxial cable terminal (20) as claimed in claim 1 wherein the contacts (22,23) are interconnected by and extend from one end of a barrel portion (24) open to each end and having a uniform inner diameter commensurate with the outer diameter of a dielectric material (13) separating the inner conductor (11) from the outer conductor (12).

3. A coaxial cable terminal (20) as claimed in claim 2 wherein the barrel portion (24) has a central longitudinal axis ex-tending parallel to and equidistant from the longitudinal axes of the contacts (22,23).

4. A coaxial cable terminal (20) as claimed in claim 3 wherein the longitudinal axes of the contacts (22,23) are equiangularly space around the barrel portion (24).

5. A coaxial cable terminal (20) as claimed in claim 4 comprising two contacts (22,23).

6. A coaxial cable terminal (20) as claimed in claim 4 wherein the contacts (22,23) are coplanar with the central longitudinal axis of the barrel portion (24).

7. A coaxial cable terminal (20) as claimed in claim 6 wherein the end of the barrel portion (24) remote from the contacts is connected coaxially with first attachment means (29) cooperative with the outer conductor (12) for providing electrical conduction between the contacts and the outer conductor (12);

and wherein the end of the first attachment means (29) remote from the barrel portion (24) is connected coaxially with second attachment means

(28) cooperative with an insulative sleeve (14) around the outer conductor (12) for securing the coaxial cable (10) to the terminal (20).

8. A coaxial cable terminal (20) as claimed in any preceding claim wherein the contacts are in the forms of pins (22,23) receivable in sockets of a reciprocal non-coaxial connector (50).

9. A coaxial cable terminal (20) as claimed in any claim preceding claim 8 wherein the contacts are in the forms of sockets for receiving pins of a reciprocal non-coaxial connector (50).

10. A non-coaxial multiple contact connector (50) comprising at least one coaxial cable terminal (20) as claimed in any preceding claim.

* * * * *